US006647684B1

(12) United States Patent
Gank

(10) Patent No.: US 6,647,684 B1
(45) Date of Patent: Nov. 18, 2003

(54) FLOORING SYSTEM

(75) Inventor: Dayton C. Gank, Terra Alta, WV (US)

(73) Assignee: High Mountain Flooring, Inc., Terra Alta, WV (US)

( * ) Notice: Subject to any disclaimer, the term of this patent is extended or adjusted under 35 U.S.C. 154(b) by 45 days.

(21) Appl. No.: 10/007,042

(22) Filed: Nov. 5, 2001

(51) Int. Cl.[7] ..... E04F 13/08

(52) U.S. Cl. ..... 52/385; 52/747.11; 52/780; 52/456

(58) Field of Search ..... 52/384, 385, 387, 52/390, 391, 747.11, 780, 403.1, 781.3, 475.1, 455, 456, 480, 762; 40/700; 15/238

(56) References Cited

U.S. PATENT DOCUMENTS 681,946 A 9/1901 Bennett
1,218,622 A 3/1917 Boving
2,015,813 A * 10/1935 Nielson ..... 52/390
3,520,095 A 7/1970 Jonason et al.
3,624,344 A 11/1971 Kutzer
3,988,187 A 10/1976 Witt et al.
4,744,194 A 5/1988 Yasuyoshi
5,438,809 A * 8/1995 Ehrlich ..... 52/390
6,073,408 A 6/2000 Winer et al.
6,129,967 A 10/2000 Young et al.
6,260,326 B1 * 7/2001 Muller-Hartburg ..... 52/601

* cited by examiner

*Primary Examiner*—Carl D. Friedman
*Assistant Examiner*—Naoko Slack
(74) *Attorney, Agent, or Firm*—Jeffrey A. Haeberlin; Middleton Reutlinger; James Daly, IV

(57) ABSTRACT

A tile and frame flooring system consisting of uniform frame elements joined together so as to create a support frame upon which a tile rests. The frame elements combine to form a lattice of support frames covering the surface to be tiled. The tiles are nestled into the frames to complete the flooring. The wood frame and tiles merge in appearance to form an aesthetically pleasing and continuous floor surface that is easy for the user to install.

17 Claims, 5 Drawing Sheets

FLOORING SYSTEM

FIELD OF THE INVENTION

This invention relates to tile and supporting structure flooring systems wherein the tile is supported in a frame of elements surrounding each tile and interconnected with each other by shared terminating ends.

BACKGROUND OF THE INVENTION

There are numerous methods and mechanisms for laying tile in a flooring system for homes and businesses. Many of these systems are difficult for the consumer to use and as such require special expertise to install.

Strong adhesives are commonly employed to secure the tile to the subflooring. This adds to the difficulty of installation, since the tiles must be aligned and held in place until the adhesive sets. Also, should the consumer ever desire to remove the flooring, the permanency of the adhesive makes this task very difficult. Alternatively, fasteners, such as nails, can be used in order to anchor the tiles to the subfloor; however, these means are unsightly if left exposed and possibly a hazard if they loosen. Concealing the fastening means adds even greater complexity to the flooring project.

Further, should a consumer wish to install a heterogeneous floor, such as one combining wood and ceramic tile elements, to present an intricate and appealing visual pattern, the degree of installation complexity increases multifold.

It would be desirable to have a flooring system that was easy to install in a home or business by the ordinary consumer, using subfloor fasteners that were both easily concealed and removed, and aesthetically appealing through the employment of complex patterns and varied construction materials.

SUMMARY OF THE INVENTION

It is an object of the present invention to provide an aesthetically appealing flooring system comprised of a frame of connected unitary elements supporting a tile within.

It is a further object of the present invention to provide a frame and tile flooring system that is easy to assemble and install by the consumer.

More particularly, the present invention is directed to a flooring frame for ceramic or other types of tiles. The frame is comprised of uniform frame elements, preferably made of a unitary piece of material, each element having the shape of an elongated hexagon. The four short sides are equal in length with the angle between the short sides being 90°.

Each short side of the frame element is also fashioned with a dowel pin on one side of the angled face and a mated recess on the other angled face. The placement of pin and recess is reversed at the opposite end of the frame element. The recess and pin placement permit the locking together of adjoining frame elements and prevents the pieces from slipping relative to each other. An extension or blind nailer is located along the base of each of the long sides of the elongated hexagonal-shaped frame element, with the end edges of the nailer being cut to match the taper of the short ends.

Thus, the elements fit together to form a frame of interlocking squares having nailers forming a tile supporting ledge upon which the tile rests. The top face of the rectangular section is exposed and becomes an aesthetic component of the flooring system. The elements are dimensioned to match the proportions of the tile to be supported. Each piece of tile will be surrounded by frame material, eliminating the use of grout. A sealer is applied to the gaps between the edges of the frame and tile in order to prevent dirt and liquids from getting under the flooring.

The present invention also relates to a method of installing the flooring system described herein.

DETAILED DESCRIPTION OF THE PREFFERED EMBODIMENT

Figure 1:
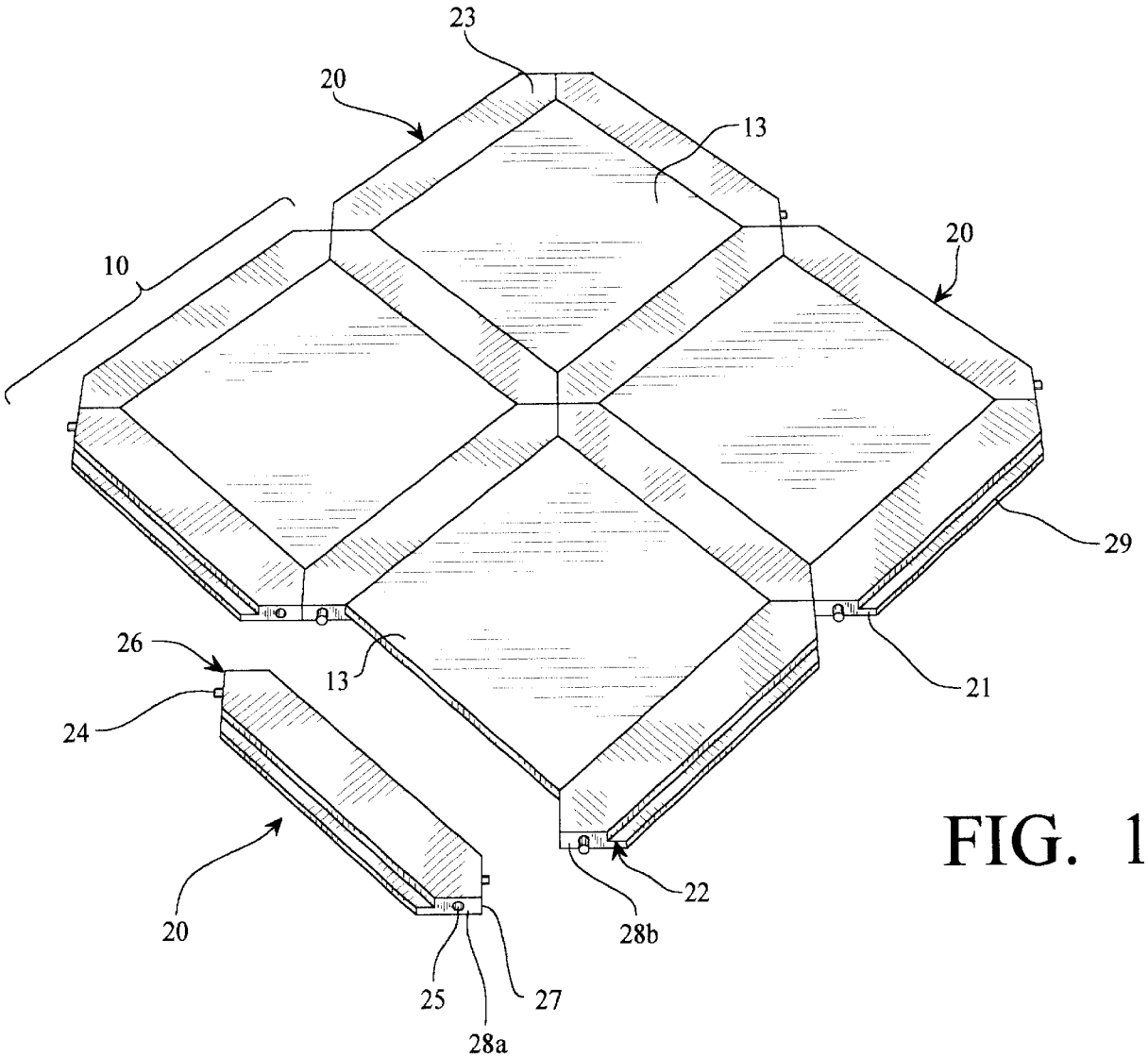
FIG. 1 is a perspective view of several sectional units of the completed flooring system showing a uniform frame element separated from the remainder of the floor.
Figure 3:
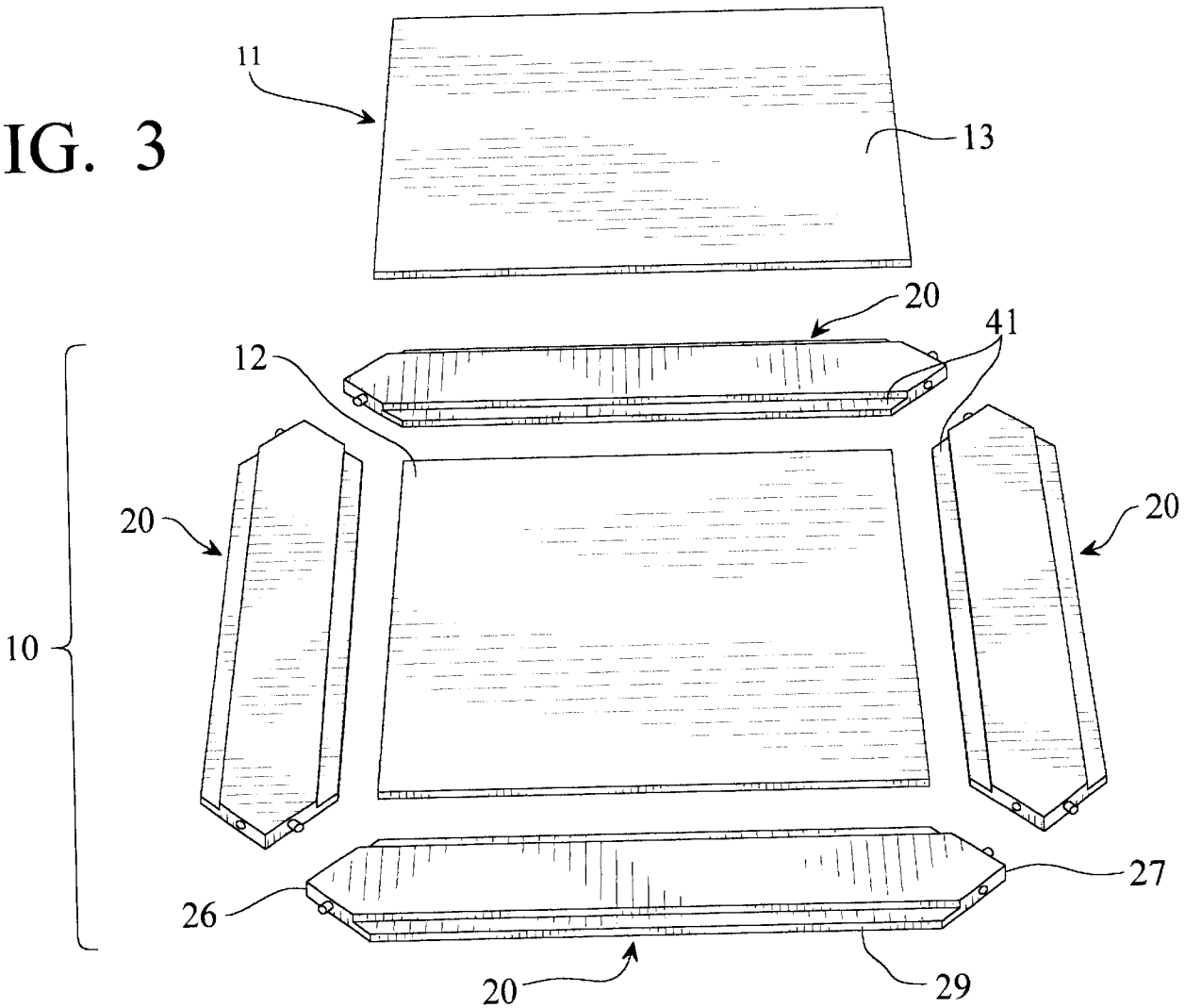
FIG. 3 is a perspective view of an exploded frame system unit.
Figure 4:
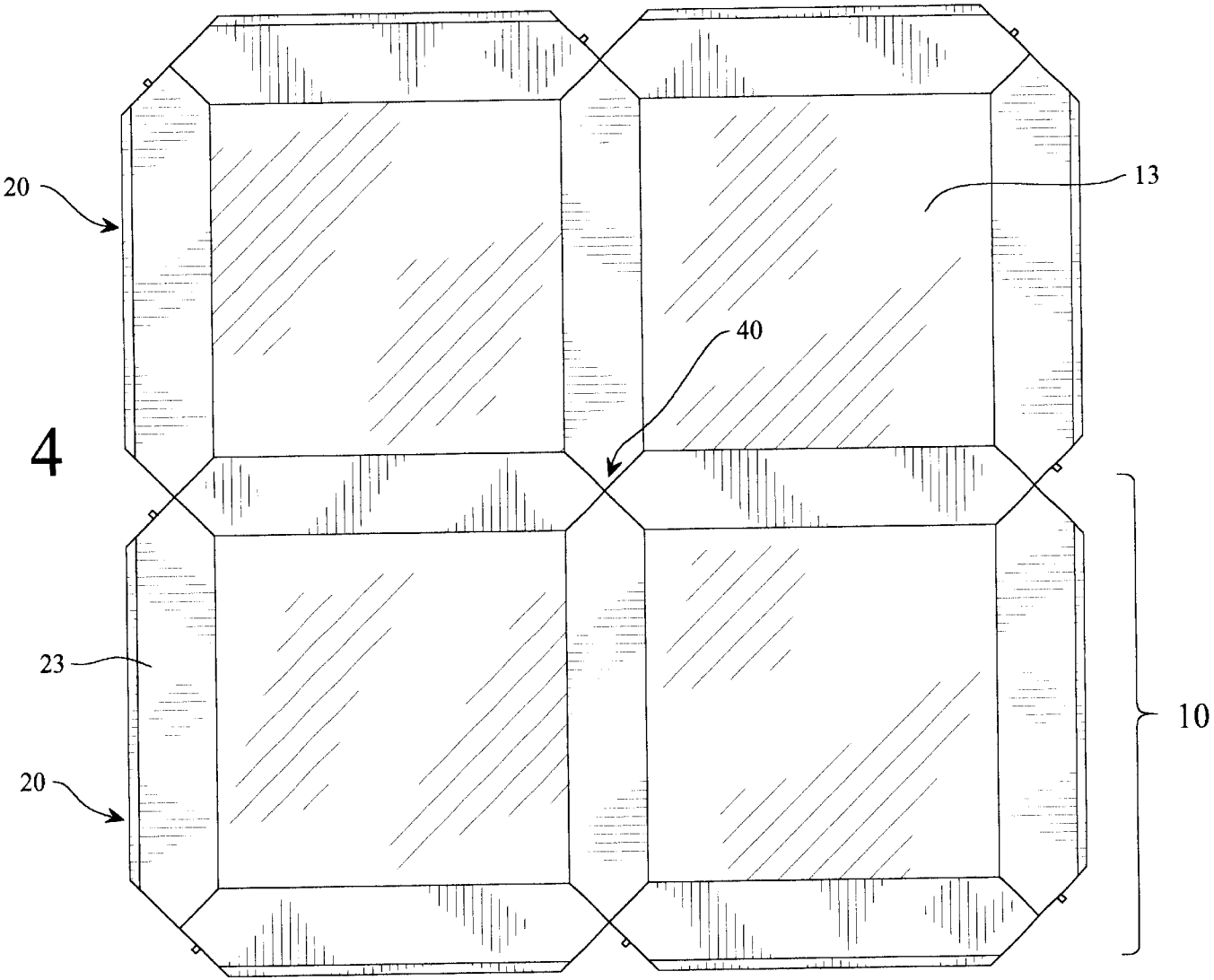
FIG. 4 is a plan view of several sectional units of the completed flooring system.

As shown in FIGS. 1, 3 and 4, frame unit 10 is composed of four hexagonal-shaped elongated uniform frame elements 20 of identical shape. As best shown in FIG. 1, each elongated frame element 20 is attached at opposing first or second terminating ends 26 or 27 to another identical frame element 20.

Figure 2:
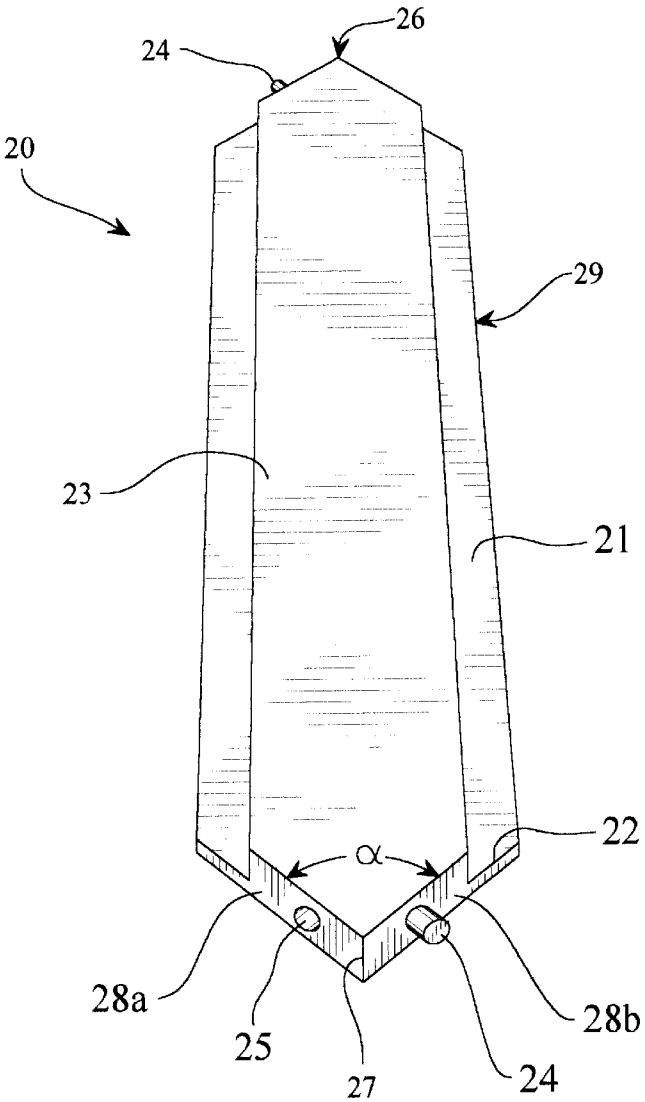
FIG. 2 is a perspective view of one of the uniform frame elements.

As best shown in FIGS. 1 and 3, each first terminating end 26 of element 20 is connectable to a second terminating end 27 of an adjacent element 20 within the same frame unit 10. As best shown in FIG. 2, one side of the first terminating end 26 defines a mated recess 25 that is sized to accept a dowel pin 24 into the mated recess 25. The dowel pin 24 is located on and affixed to one side of the second terminating end 27. Both first 26 and second 27 terminating ends each have a dowel pin 24 on one side 28*b* of the end and a mated recess 25 on the adjacent side 28*a* of the same end. The difference between the first 26 and second 27 terminating ends is only that the dowel pins 24 and mated recesses 25 are on opposite sides 28*a*&*b* of each end. This permits the elements 20 to fit together into a unit 10 on one side of each element 20 and permits connection of the element 20 in one unit 10 to another element 20 in an adjacent unit 10, as shown in FIGS. 1 and 4. The angle of the sides 28*a*&*b* of each terminating end 26 or 27 in relation to each other is 90°. This angle a results in the frame unit 10 forming a perfect square of connected elements 20. Other means for attaching the terminating ends can be used as may be appropriate, but the dowel pin and mated recess type fitting is preferred.

As shown in FIG. 4, the individual elements 20 fit together to form a frame unit 10 and then each frame unit 10 further fits together with another frame unit 10, each unit sharing one of its sides with the adjacent unit. The units 10 combine to form a continuous frame lattice over the entire surface to be covered. The junction of each group of four units creates a distinctive "X" pattern 40 that repeats across the entire surface and further adds to the aesthetic appeal of the completed floor.

The ease in which assembly of the flooring system is achieved is now described. The installer begins in the corner of the room and connects two frame elements 20 together to form a right angle, and aligns these elements 20 with the corner of the room. The remaining two frame elements 20 are connected to the right angle to form the first complete frame unit 10. More frame elements 20 are added to the first unit 10 in order to create adjoining frame units 10 until the surface to be tiled is covered with a lattice of interconnected frame units 10. The elements 20 are affixed to the subfloor as each unit 10 is completed, or as each element 20 is added to the growing lattice.

As seen in FIG. 2, each element 20 has on both of the vertical surfaces 29 of its elongated sides an extension 21 along the bottom portion of the vertical surface it 29 referred to hereinafter as a blind nailer. The extension or blind nailer 21 terminates at both ends in a taper cut 22 that aligns with the angle of the first end 26 and second end 27. The blind nailer 21 functions as a hidden means of affixing the frame unit 10 to the subflooring. Flooring nails are hammered through the blind nailer 21 and into the subfloor thus securely fixing the unit 10 to the subfloor and preventing slippage of the floor as a whole (not shown). Further, as shown in FIG. 3, the blind nailers 21 of the completed frame unit together form a tile supporting ledge 41 upon which the tile rests when properly positioned. Therefore, when a tile 11 is positioned in the frame 10, the nails and the nailer 21 are hidden from view, thus presenting a more appealing surface.

Figure 5:
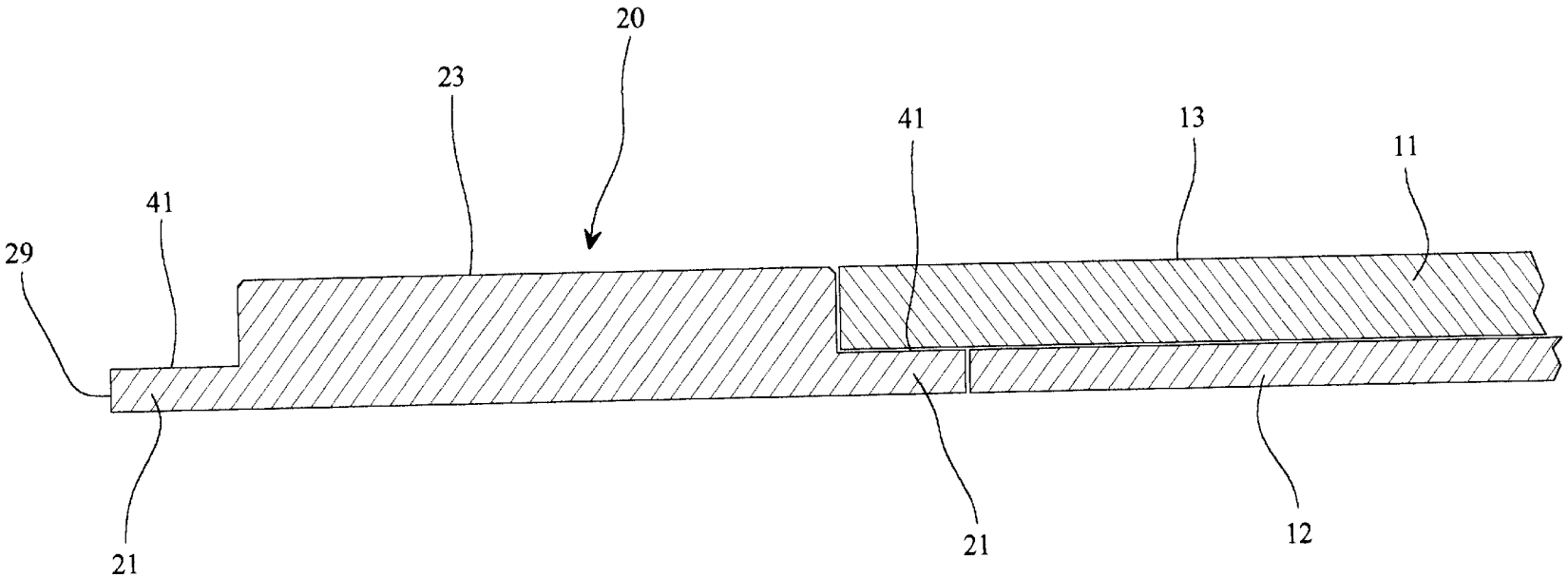
FIG. 5 is a sectional view of a uniform frame element and associated tile and subsupport.

As shown in FIG. 3, a subsupport square 12, having dimensions slightly smaller than the perimeter created by the four blind nailers 21 of the surrounding elements 20 that make up a particular unit 10, is placed within the unit 10 and in direct contact with the subfloor. As best shown in FIG. 5, the height of the subsupport square 12 is equal to the height of the blind nailers 21. Thus, the subsupport square 12 acts as a further support for the tile 11, which is positioned on top of the blind nailers 21 and the subsupport square 12 and between the elements 20 of a unit 10. A sealant may then be applied to the slight gap between the edges of the tile 11 and the edges of the elements 20 in order to prevent particulate matter and liquids from falling into the gap. After the complete lattice is assembled and the tile installed, the finished product appears as best shown in FIG. 4. Only the top surface 23 of each element 20 and the top surface of the tiles 13 are visible to the eye after the floor is completely assembled. None of the subfloor anchoring means is visible. This gives a uniform appearance and alternating pattern of tile and frame elements that is aesthetically pleasing to behold.

One preferred composition of the frame elements 20 is wood. Any type of wood that is strong enough to be used as flooring is acceptable. For example, oak, cherry, pine or veneers of wood are preferred materials for the elements 20. The wood may be chosen to match existing décor and fixtures. The wood may be stained or painted as appropriate to further its aesthetic appeal. The frame elements 20 may also be composed of different metals, as well as stone, such as marble, or composite resins. A preferred tile 11 is ceramic. However, it may also be composed of stone, such as marble, granite or slate, wood or other substances commonly available as tiling material.

The dimensions of the frame elements 20 may be as large as needed to produce a unit 10 of size required to support the desired tile 11. One preferred embodiment is an element 20 having a length of between six and thirty-six inches and a width of one to five inches, not including the blind nailers 21.

It will be realized by one skilled in the art that various changes may be made to the specific embodiments disclosed and described without departing from the principals and spirit of the present invention.

What is claimed is:

1. A floor frame system, comprising:

a plurality of uniform frame elements each having an elongated frame section with a first terminating end, a second terminating end opposed to said first terminating end, and elongated sides extending between said first and second terminating ends, each of said first and said second terminating ends having a first and a second short side, said short sides forming an angle of 90° there between, each of said elongated sides having a vertical surface, each of said frame elements also having opposed elongated extensions integral with and extending outwardly from a bottom portion of each of said vertical surfaces of said elongated frame section elongated sides; and said plurality of uniform frame elements fixedly connected at right angles at said terminating ends to form a closed frame unit, one of said elongated extensions being interior of said frame unit and defining a tile supporting ledge.

2. A flooring system, comprising:

a plurality of uniform frame elements each having an elongated frame section with a first terminating end, a second terminating end opposed to said first terminating end, and elongated sides extending between said first and second terminating ends, each of said first and said second terminating ends having a first and a second short side, said short sides forming an angle of 90° there between, each of said elongated sides having a vertical surface, each of said frame elements also having opposed elongated extensions integral with and extending outwardly from a bottom portion of each of said vertical surfaces of said elongated frame section elongated sides;

said plurality of uniform frame elements fixedly connected at right angles at said terminating ends to form a closed frame unit, one of said elongated extensions being interior of said frame unit and defining a tile supporting ledge;

a subsupport piece positioned inside an area defined by said tile supporting ledge of said frame unit; and a tile positioned so as to rest upon said tile supporting ledge and on top of said subsupport piece.

3. The flooring system of claim 2, said first and said second terminating ends of said frame unit having a dowel pin fixedly attached to a vertical surface of said first short side and said second short side defines an area on a vertical surface surrounding a mated recess.

4. The flooring system of claim 3, the placement of said first terminating end dowel pin being in vertical alignment with said second terminating end mated recess and said first terminating end mated recess is in vertical alignment with said second terminating end dowel pin.

5. The flooring system of claim 2, each of said elongated extensions being a blind nailer.

6. The flooring system of claim 5, said blind nailers being tapered at each end to match the angle of said first and said second terminating ends.

7. The flooring system of claim 6, said blind nailers having a height equal to that of the height of said vertical surface of said frame element less the height of said tile.

8. The flooring system of claim 7, said subsupport square having a height equivalent to that of the height of said blind nailer and a length and a width equivalent to that of a border defined by said blind nailers.

9. The flooring system of claim 2, said tile being of a size equivalent to said area defined by said frame unit.

10. The flooring system of claim 2, the length and width of said frame elements being of a size so that when said plurality of frame elements is joined to form said frame unit, said frame unit interior dimensions are nearly equivalent to said tile dimensions.

11. The flooring system of claim 10, said frame elements having a length of between six and thirty-six inches and a width of between one and five inches, exclusive of the width of said blind nailer.

12. The flooring system of claim 11, said frame elements having a length of twelve inches and a width of two inches, exclusive of said blind nailer width.

13. The flooring system of claim 2, said frame elements being composed of a material selected from the group consisting of wood, metal and minerals.

14. The flooring system of claim 2, said tiles being composed of a material selected from the group consisting of ceramic, stone, marble, granite, slate or wood.

15. A flooring system, comprising:

a plurality of uniform frame elements each having an elongated frame section with a first terminating end, a second terminating end opposed to said first terminating end, and elongated sides extending between said first and second terminating ends, each of said first and said second terminating ends having a first and a second short side, said short sides forming an angle of 90° there between, each of said elongated sides having a vertical surface, each of said frame elements also having opposed elongated extensions integral with and extending outwardly from a bottom portion of each of said vertical surfaces of said elongated frame section elongated sides;

said plurality of uniform frame elements fixedly connected at right angles at said terminating ends to form a closed frame unit, one of said elongated extensions being interior of said frame unit and defining a tile supporting ledge;

a subsupport piece positioned inside an area defamed by said tile supporting ledge of said frame unit; and a tile positioned so as to rest upon said tile supporting ledge and on top of said subsupport piece; and a sealant material applied to the area between said tile and said frame elements, intimately contacting said tile and said frame elements, and completely sealing said area, preventing a foreign substance from entering said area and further preventing slippage of said tile.

16. A method of assembling a flooring system, comprising the steps of:

connecting four uniform frame elements each having an elongated frame section with a first terminating end, second opposed terminating end, and elongated sides extending between said first and second terminating ends, each of said first and said second terminating ends having a first and a second short side, said short sides forming an angle of 90° there between, each of said elongated sides having a vertical surface, each of said frame elements also having opposed elongated extensions integral with and extending outwardly from a bottom portion of each of said vertical surfaces of said elongated frame section elongated sides, to each other at right angles at said first and second terminating ends of each element to form a frame unit with a square configuration;

placing said frame unit on a subfloor to be covered and aligning two of said connected frame elements with a corner of a room;

affixing said frame unit to said floor by nailing a nail through one of said elongated extensions and into a subfloor;

positioning a subsupport square within the center of said frame unit; and positioning a tile on top of and in direct contact with said support square and within the center of said frame unit.

17. The method of claim 16, further comprising the steps of:

connecting said terminating ends of three additional frame elements with said frame unit at said terminating ends to form a second frame unit;

affixing said second frame unit to said floor by nailing a nail through at least one of said elongated extensions of said additional frame elements and into a subfloor;

positioning a second subsupport square within the center of said second frame unit; and positioning a second tile on top of and in direct contact with said second support square and within the center of said second frame unit, repeating the above steps of connecting said frame elements to said completed frame units, fastening said frame units to said subfloor, positioning said subsupport squares and said tiles in the center of said frame units, until a matrix of interconnected frame units covers said subsupport floor.

* * * * *